10/15/85 OR 4,547,264

United States Patent [19]

Sherman et al.

[11] Patent Number: 4,547,264

[45] Date of Patent: Oct. 15, 1985

[54] METHOD OF WITHDRAWING LIQUID FROM A PAIR OF VERTICALLY SPACED ANNULAR SCREENS

[75] Inventors: Michael I. Sherman; Joseph R. Phillips, both of Glens Falls, N.Y.

[73] Assignee: Kamyr, Inc., Glens Falls, N.Y.

[21] Appl. No.: 263,082

[22] Filed: May 12, 1981

Related U.S. Application Data

[63] Continuation of Ser. No. 172,973, Jul. 28, 1980, abandoned, which is a continuation of Ser. No. 11,662, Feb. 12, 1979, abandoned.

[51] Int. Cl.[4] ..... D21C 7/14

[52] U.S. Cl. ..... 162/37; 162/59; 162/250; 162/251; 210/805

[58] Field of Search ..... 162/251, 37, 40, 41, 162/42, 17, 19, 57, 237, 59, 250, 248, 249; 210/74, 194, 805, 806; 8/156; 68/181 R

[56] References Cited

U.S. PATENT DOCUMENTS

| | | | |
|---|---|---|---|
| 2,695,233 | 11/1954 | Richter | 162/251 |
| 3,711,367 | 1/1973 | Christenson | 162/251 |
| 3,811,994 | 5/1974 | Ostberg | 162/19 |
| 4,061,193 | 12/1977 | Laakso et al. | 162/251 |

FOREIGN PATENT DOCUMENTS

| | | | |
|---|---|---|---|
| 0893441 | 10/1953 | Fed. Rep. of Germany | 162/248 |
| 0145257 | 2/1954 | Sweden | 162/249 |

*Primary Examiner*—Steve Alvo

*Attorney, Agent, or Firm*—Cushman, Darby & Cushman

[57] ABSTRACT

A method and apparatus for selectively withdrawing liquor from digester cooking screens for controlling the temperature in continuous digesters. First and second pairs of screens, with cooperating headers, are provided, and first and second outlets spaced circumferentially around the digester are associated with each header. Each header provides a circumferential cavity free of dividing members. Within each pair of screens withdrawal is practiced so that each header is rested during each ultimate withdrawal step, and the side from which the liquor is drawn each successive withdrawal step that the same header is used is alternated. In practicing the invention, header blockage caused by deposited debris and scale is minimized and increased uniformity and improved product quality result.

4 Claims, 6 Drawing Figures

METHOD OF WITHDRAWING LIQUID FROM A PAIR OF VERTICALLY SPACED ANNULAR SCREENS

This is a continuation of application Ser. No. 172,973 filed July 28, 1980, now abandoned, which in turn is a continuation of Ser. No. 011,662 filed Feb. 12, 1979, filed now abandoned.

BACKGROUND AND SUMMARY OF THE INVENTION

Essentially all continuous digesters for producing pulp from cellulosic chips material contain screens for withdrawing liquor from the cooking portions of the digester, heating the withdrawn liquor to control the temperature thereof, and returning the liquor to the cooking portion of the digester. Numerous different types of proposals have been made for the exact manner of effecting the liquid withdrawal, such as shown in U.S. Pat. Nos. 2,695,232; 3,711,367; and 4,061,193. Many conventional commercial digesters have two upper cooking circulation screens and two lower cooking circulation screens, with associated headers, with one outlet extending from each header.

While conventional techniques for effecting cooking liquor recirculation are normally satisfactory, in larger digesters pulp uniformity and quality sometimes suffer as a result of problems in digesting liquor circulation. This is particularly true for digesters having a diameter of about 14' or more.

According to the present invention, the sources of the problems with pulp quality and uniformity as a result of cooking liquor recirculation have been identified, and pulp uniformity and quality have been improved in a simple, economical and common effective manner. It has been recognized that as the distance from the central distribution pipe for the cooking liquor recirculation to the digester wall increases, it is easier for the liquor to find its own path as it moves through the chips near the wall area. It has been further determined that as the distance around the liquor collection headers under the screens is increased it becomes increasingly more difficult to compensate for pressure drops down the header as more liquor is picked up from the bottom of each screen, which problem is accentuated as the header scales up. It has been further determined that in the period between acid cleanings, the headers gradually plug up with accumulated scale and debris, and this accumulation is nonuniform and is also worse at the point of lowest velocity. Finally, it has been recognized that because of scaling, screens are normally installed that have much more screen area than is ncessary to support the design flow; when the screens are clean, the liquor can choose its own path because of larger area available, and as the screens scale the scaling and deposits prevent an even flow distribution, thus there is always some problem with distribution whether the screens are clean or scaled up. This flow distribution problem is further aggravated since the screen area varies directly as the diameter, whereas the tonnage (and required circulation flow) varies as the square of the digester diameter, and for larger digesters the only way to hold the loading per unit screen area down would be to make the screens very tall, which involves considerable expense for both the screens and the digester shell.

According to the present invention, the flow distribution problems that result in decreased product unformity and quality have been solved in a simple and efficient manner. According to the present invention, instead of providing one liquor outlet with each header a pair of circumferentially spaced (e.g., 180°) outlets are provided with each header, no restrictions being provided in the headers preventing flow from one portion of the header to another; and a method of withdrawing liquor from the outlets is provided that ensures that a header of each header pair is rested during each alternate withdrawal step, and that the side from which liquor is withdrawn is alternated each successive time that a header is used. This varies the position from which the liquor is extracted and ensures that no paths are set up inside the digester where liquor is always pulled only one way, this being particularly important as the screen starts to scale over. By switching from one side to the other, the low velocity point in the headers is moved from cycle-to-cycle and all points of the header are exposed to a high velocity at least once per complete cycle. This keeps debris and scaling from occurring in the section of the header which was previously only exposed to low velocity liquor, keeping the header much cleaner and preventing any channelling effects due to header blockage caused by deposits, debris and scale from originating. In comparative tests of the switching apparatus and method according to the invention and conventional arrangements utilizing only one liquor withdrawal outlet per header, it was found that increased uniformity and improved product quality unmistakably resulted from the practice of the invention.

In particular, according to the present invention a method of withdrawing liquid from a pair of vertically spaced annular screens in a vertical vessel is provided. Each screen has an annular header associated therewith and two circumferentially spaced liquid outlets are associated with each header, so that first and second headers each having first and second outlets are provided. The method comprises the steps of substantially sequentially withdrawing liquid from the first header first outlet; terminating withdrawal of liquid from the first header first outlet and withdrawing liquor from the second header first outlet; terminating withdrawal of liquid from the second header first outlet and withdrawing liquid from the first header second outlet; terminating withdrawal of liquor from the first header second outlet and withdrawing liquor from the second header second outlet; and repeating the above steps with appropriate frequency to minimize header blockage caused by deposit of debris and scale. Preferably, the first outlets of the first and second headers are somewhat circumferentially spaced from each other, and the second outlets of the first and second headers are somewhat circumferentially spaced from each other. Also, preferably a second pair of annular screens with associated headers and liquor outlets are provided vertically spaced from the first pair, with a withdrawal sequence from the second pair liquor outlets substantially coincident with the withdrawal from the first pair corresponding liquor outlets.

Further according to the present invention, a continuous digester for cellulosic pulp material is provided including a vertically extending elongated vessel; a pair of circumferentially spaced annular screens disposed in the vessel, each having an annular header associated therewith; a first liquid outlet associated with each header; means for withdrawing liquid from the vessel operatively connected to each outlet; means for heating the withdrawn liquid and returning it to the interior of the vessel; and means for selectively providing withdrawal from a given outlet while preventing withdrawal from the other outlets. The improvement comprises a second liquid outlet provided with each header and circumferentially located approximately 180° from the first outlet provided with each header, the second outlets operatively connected to the liquid withdrawing and selective withdrawal providing means so that liquid is withdrawn from only one said outlet at a time while withdrawal from the other said outlets is prevented. Such apparatus is particularly effective in the digester having a diameter of about 14' or greater.

It is the primary object of the present invention to provide a method and apparatus for the withdrawal and recirculation of cooking liquor in continuous digesters to minimize header blockage caused by deposited debris and scale, and to increase pulp uniformity and quality. This and other objects of the invention will become apparent from an inspection of the detailed description of the invention, and from the appended claims.

DETAILED DESCRIPTION OF THE DRAWINGS

Figure 1:
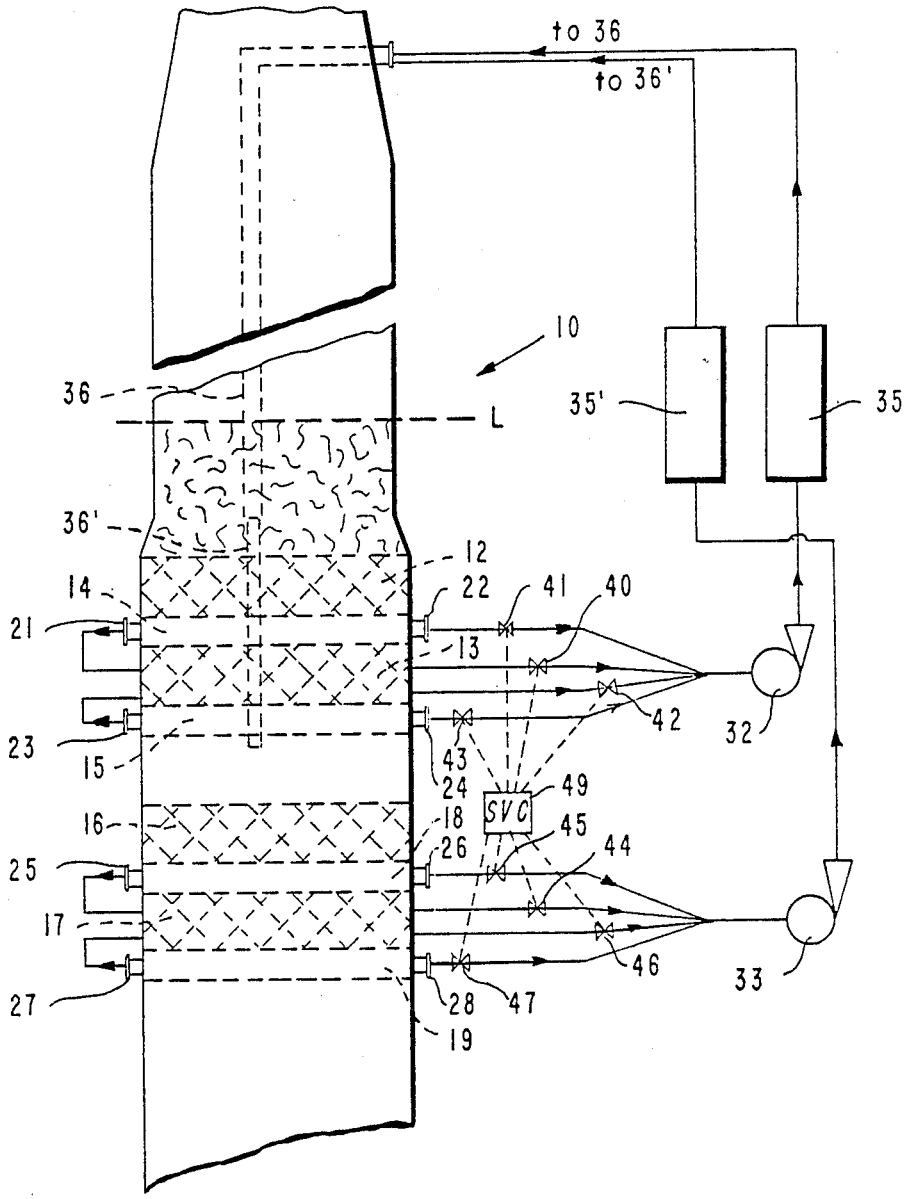
FIG. 1 is a diagrammatic view of the relevant portions of a continuous digester utilizing an exemplary withdrawal system according to the prevent invention.
Figure 2:
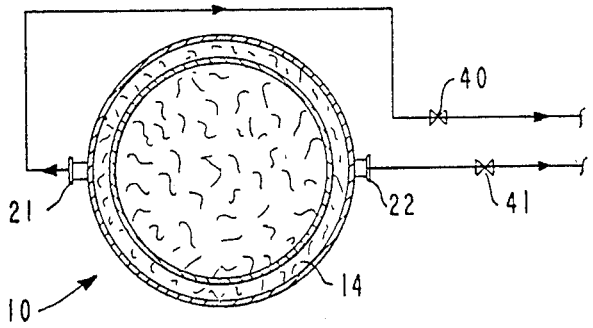
FIG. 2 is a top sectional view taken along the digester of FIG. 1 at one of the headers thereof.
Figure 3A:
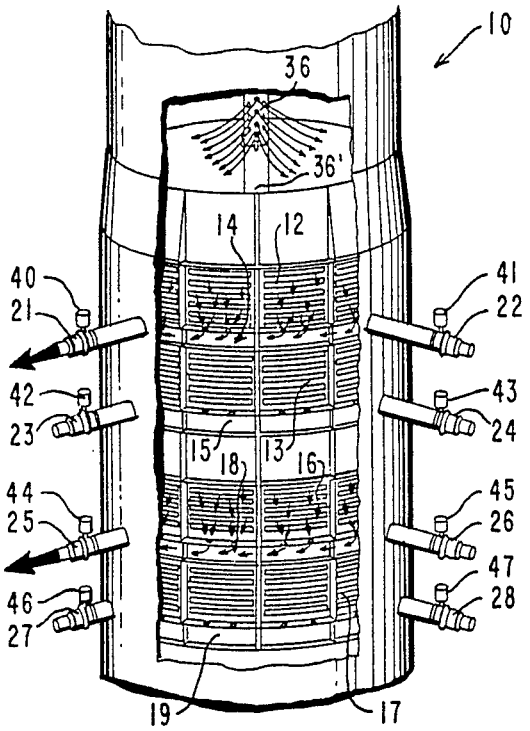
FIG. 3*a* through 3*d* are schematic perspective views, with portions cut away for clarity, illustrating a sequence of exemplary steps for practicing a method according to the present invention.
Figure 3B:
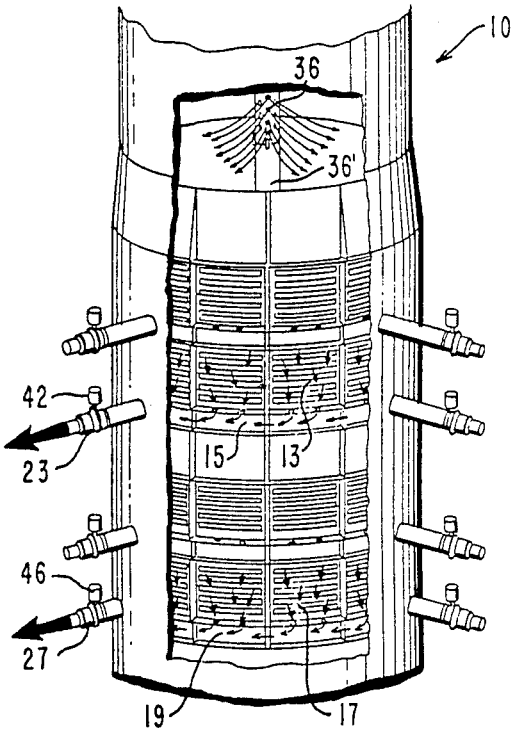
Figure 3C:
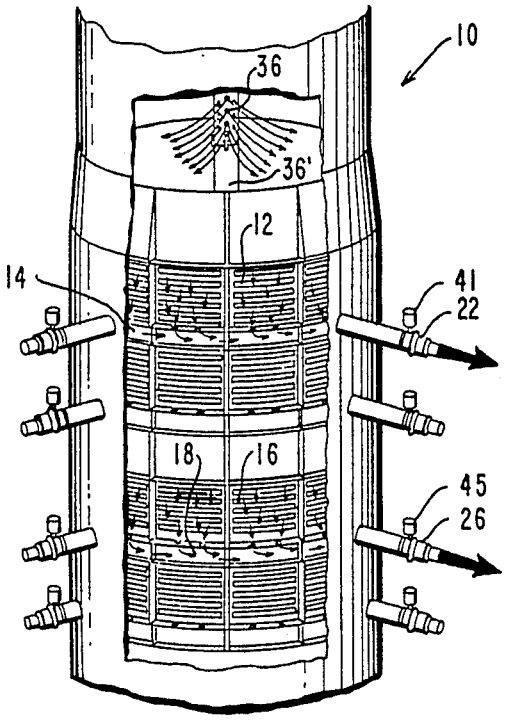
Figure 3D:
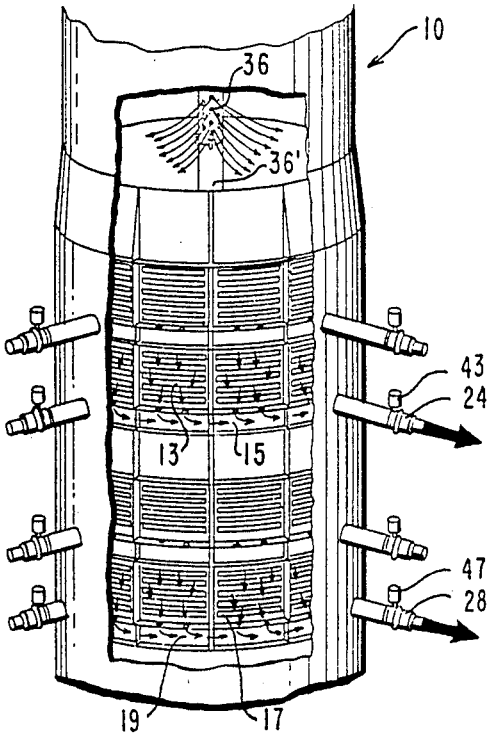

An exemplary continuous digester with which the switching system according to the present invention is employed is illustrated generally at 10 in the drawings. The digester includes a pair of circumferentially spaced annular screens 12, 13, disposed therein, each having an annnular header 14, 15 associated therewith. As illustrated most clearly in FIG. 2 and FIGS. 3*a* through 3*d*, preferably each header provides a substantially circumferentially continuous cavity, being free of circumferential dividing members. Preferably, a second pair of vertically spaced annular screens 16, 17 are also provided in the vessel 10, vertically spaced from the first pair of screens 12, 13, and having headers 18, 19 associated therewith.

According to the present invention, each annular header 14, 15, 18, 19 has first and second liquid outlets associated therewith, the liquid outlets being circumferentially spaced around the digester 10 (preferably spaced 180° apart). First outlets 21, 23, 25 and 27 are associated with the headers 14, 15, 18 and 19, respectively, as are second outlets 22, 24, 26 and 28, respectively.

Means are provided for withdrawing liquid from the vessel 10, such means being operatively connected to each outlet 21 through 28. Such withdrawing means preferably takes the form of one or more pumps 32, 33. The pumps 32 and 33 are connected up to means for heating the withdrawn liquid and returning it to the interior of the vessel 10, such means taking the form of conventional heaters 35, 35' and central distribution pipes 36, 36' for the upper and lower screen sets respectively. There is further provided means for selectively providing withdrawal of liquid from a given outlet while preventing withdrawal from the other outlets. Such selective withdrawal providing means include a plurality of valves—such as solenoid controlled valves—40 through 47, one associated with each outlet 21 through 28, with a common electric control element 49 for selectively controlling operation of the valves 40 through 47 according to a predetermined sequence. During operation of the digester 10, cellulosic chips material preferably maintain a level L (see FIG. 1), chips being in contact with the screens 12, 13, 16 and 17 during operation of the vessel 10.

The practice of the method according to the present invention is seen most clearly with reference to FIGS. 3*a* through 3*d*. For clarity of illustration in FIGS. 3*a* through 3*d*, the first and second outlet pipes (e.g., 21, 22) associated with each header (e.g., 14) are shwon at substantially less than 180° apart, although normally the outlets will be spaced approximately 180° apart. In practicing the method according to the present invention, each header is alternately rested in successive withdrawal steps, and the side from which the liquor is withdrawn each successivẽ time that a particular header is used is alteranted.

With reference to FIGS. 3*a* through 3*d*, an exemplary method according to the present invention comprises the steps of substantially sequentially (a) withdrawing liquid from the first header 14 first outlet 21; (b) terminating withdrawal from the outlet 21 and withdrawing liquid from the second header 15 first outlet 23; (c) terminating withdrawal of liquid from the outlet 23 and withdrawing liquid from the first header 14 second outlet 22; (d) terminating withdrawal of liquid from the outlet 22 and withdrawing liquid from the second header 15 second outlet 24; and (e) repeating steps (a) through (d), and with appropriate frequency, to minimize header blockage caused by deposited debris and scale. The control mechanism 49 controls the valves 40, 41, 42, and 43 to effect the above withdrawal sequencing, each withdrawal step being practiced for a few minutes before sequencing, under normal circumstances. The method according to the present invention is applicable whether the first outlets 21, 23 are on the same side of the digester 10, are located on opposite sides thereof, or are otherwise circumferentially spaced (and likewise for the second outlets 22, 24), or are circumferentially coincident.

The method according to the present invention is preferably practiced with the third and fourth headers 18, 19 also being provided, the third and fourth headers 18, 19 having first outlets 25, 27 associated therewith, and second outlets 26, 28 associated therewith. Utilizing such third and fourth headers, the method comprises the further steps of (f) substantially coincident with step (a), withdrawing liquid from the third header 18 first outlet 25; (g) substantially coincident with step (b), withdrawing liquid from the fourth header 19 first outlet 27 while terminating withdrawal from the outlet 25; (h) substantially coincident with step (c), withdrawing liquid from the third header 18 second outlet 26 while terminating whitdrawal from outlet 27; (i) substantially coincident with step (d), withdrawing liquid from the fourth header 19 second outlet 28 while terminating withdrawal from the outlet 26; and (j) repeating steps (f) through (i) substantially coincidentally with steps (a) through (d), respectively, and with appropriate frequency to minimize header blockage by deposited debris and scale. The common control mechanism 49 controls coincident operation of the valves 40, 44; 42, 46; 41, 45; and 43, 47, to effect the above sequencing of withdrawal steps.

Thus, it will be seen that according to the present invention a simple switching system and method have been provided which minimize header clogging due to debris and scale deposition, and which improve pulp quality and uniformity compared to conventional arrangements. While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent methods and structures.

What is claimed is:

1. A method of withdrawing liquid from a pair of vertically spaced annular screens in a vertical vessel, each having an annular header associated therewith, and two circumferentially spaced liquid outlets being associated with each header, so that first and second headers each having first and second outlets, are provided, each header providing substantially circumferentially continuous cavity free of circumferential dividing members; said method comprising the steps of substantially sequentially (a) withdrawing liquid from the first header outlet;

(b) terminating withdrawal of liquid from the first header first outlet and withdrawing liquid from the second header first outlet;

(c) terminating withdrawal of liquid from the second header first outlet and withdrawal liquid from the first header second outlet;

(d) terminating withdrawal of liquid from the first header second outlet and withdrawal liquid from the second header second outlet; and (e) repeating steps (a)–(d), and with appropriate frequency to minimize header blockage caused by deposited debris and scale.

2. A method as recited in claim 1 wherein a second pair of vertically spaced annular screens are provided in the vertical vessel, vertically spaced annular screens are provided in the vertical vessel, vertically spaced from the first pair having an annular header associated therewith and two circumferentially spaced liquid outlets being associated with each header, so that third and fourth headers each having first and second outlets, are provided, each header providing a substantially circumferentially continuous cavity free of circumferential dividing members; said method comprising the further steps of (f) substantially coincident with step (a), withdrawing liquid from the third header first outlet;

(g) substantially coincident with step (b), withdrawing liquid from the fourth header first outlet while terminating withdrawal from the third header first outlet;

(h) substantially coincident with step (c), withdrawing liquid from the third header second outlet while terminating withdrawing from the fourth header first outlet;

(i) substantially coincident with step (d), withdrawing liquid from the fourth header second outlet while terminating withdrawal from the third second outlet; and (j) repeating steps (f)–(i) substantially coincidently with steps (a)–(d), respectively, and with appropriate frequency to minimize header blockage by deposited debris and scale.

3. A method as recited in claim 2 wherein said first through fourth headers are disposed in vertically descending order.

4. A method as recited in claim 1 wherein the vessel is a digester with cellulosic chips in contact with the screens, and comprising the further steps of heating the withdrawn liquid and returning it to the interior of the vessel for treatment of cellulosic chips therein.

* * * * *